US006988323B2

(12) United States Patent
McAdam

(10) Patent No.: US 6,988,323 B2
(45) Date of Patent: Jan. 24, 2006

(54) TOOL KIT AND METHOD FOR WORKING SHEET METAL TRIMS

(76) Inventor: Perry McAdam, 12 Maple Street, Harvey, New Brunswick (CA) E6K 2P2

( * ) Notice: Subject to any disclaimer, the term of this patent is extended or adjusted under 35 U.S.C. 154(b) by 0 days.

(21) Appl. No.: 10/853,218

(22) Filed: May 26, 2004

(65) Prior Publication Data

US 2004/0250436 A1 Dec. 16, 2004

Related U.S. Application Data

(60) Provisional application No. 60/477,021, filed on Jun. 10, 2003.

(51) Int. Cl.
*G01B 3/56* (2006.01)

(52) U.S. Cl. ..... 33/534; 33/562

(58) Field of Classification Search ..... 33/534–537, 33/562; 72/31.1, 319

See application file for complete search history.

(56) References Cited

U.S. PATENT DOCUMENTS

| | | | | | |
|---|---|---|---|---|---|
| 1,754,903 | A * | 4/1930 | Nearing | 33/494 |
| 3,003,244 | A * | 10/1961 | Fogliano | 33/341 |
| 3,596,492 | A | 8/1971 | Swanson | |
| 3,623,231 | A * | 11/1971 | Holt | 33/538 |
| 3,730,631 | A * | 5/1973 | Streander | 356/150 |
| 4,111,027 | A | 9/1978 | Bottomley | |
| 4,282,735 | A | 8/1981 | Break | |
| 4,578,980 | A * | 4/1986 | Beckman | 72/319 |
| 4,594,867 | A | 6/1986 | Andersen | |
| 4,660,293 | A * | 4/1987 | Kovacs | 33/471 |
| 4,744,152 | A * | 5/1988 | Roach et al. | 33/471 |
| 4,768,367 | A | 9/1988 | Favrin | |
| 4,945,649 | A | 8/1990 | Parker | |
| 5,251,382 | A * | 10/1993 | Hellar | 33/759 |
| 6,722,050 | B2 * | 4/2004 | Winton, III | 33/534 |
| 2002/0133961 | A1 * | 9/2002 | Tomiser et al. | 33/534 |

* cited by examiner

*Primary Examiner*—Christopher W. Fulton
*Assistant Examiner*—Tania Courson
(74) *Attorney, Agent, or Firm*—Mario Theriault

(57) ABSTRACT

The tool kit comprises a set of angle gauges for measuring angles in a workpiece being formed in a sheet metal bender, and printed math tips and charts related to the angle gauges. Each angle gauge has an elongated shape with juxtaposed longitudinal base surface and longitudinal angled surface, and an indicia thereon indicating a nominal angle. The angled surface makes a true angle with a transverse projection of the base surface. This true angle corresponds to the sum of the nominal angle on the indicia plus a supplement angle. The nominal angles on the angle gauges in the set are different from each other, and the supplement angle is common to all angle gauges in the set. The supplement angle corresponds to the slope of the nose bar in the sheet metal bender. The entire set can be used on a same bender to measure different angles.

20 Claims, 5 Drawing Sheets

TOOL KIT AND METHOD FOR WORKING SHEET METAL TRIMS

FIELD OF THE INVENTION

This invention pertains to gauges and instructions for bending sheet metal, and more particularly it pertains to angle gauges and corresponding trigonometric tables to facilitate the fabrication of sheet metal building trims.

BACKGROUND OF THE INVENTION

When installing aluminum or vinyl siding on a building, aluminum caps are also installed over the window frames and the eaves of the building. In many cases, cornices and friezes are also installed above the windows and doors to further decorate the building. While some decorative mouldings can be purchased prefab, most installers prefer to form the aluminum covers onsite using a portable sheet metal bender. However, the bending of sheet metal represents a challenge, especially to the novice or the apprentice in the trade and sometimes large amount of material and time can be wasted before quality work is obtained.

The known sheet metal benders are sold without stopper to limit the movement of their aprons to a specific angle. The frequent users of sheet metal benders eventually develop a skill for judging the working of the apron to obtain the desired angle, taking into consideration the material thickness and the amount of spring back. However, even the experienced tradesmen must remove the workpiece from the bender once or twice, measure the angle at several places along the bend, and put the workpiece back into the bender to readjust the angle of the bend.

It is believed that the prior art is generally short of suggestion with regards to controlling the movement of the apron of a sheet metal bender to obtain the desired bend at the first time. As such, it may be appreciated that there continues to be a need for a tool kit that may be used by aluminum siding installers to facilitate their work.

SUMMARY OF THE INVENTION

In the present invention, there is provided a set of angle gauges that are laid on the workpiece while the workpiece is being bent in the bender, to measure at a glance the angle being formed and to obviate the need for removing the workpiece from the bender several times before obtaining the required bend.

In one aspect of the present invention, there is provided an angle gauge having an elongated shape with juxtaposed longitudinal base surface and longitudinal angled surface, and an indicia applied thereon indicating a nominal angle. The angled surface makes a true angle with a transverse projection of base surface. The true angle is larger than the nominal angle to accommodate for the thickness of the nose bar in the sheet metal bender. When using a portable common sheet metal bender having a nose bar tapering along a 20° slope, the true angle corresponds to the sum of the nominal angle shown on the indicia and a supplement angle of 20°.

In use, the angle gauge is laid on the nose bar of the bender and on the workpiece as the workpiece is being formed, to monitor the formation of the workpiece to the desired nominal angle.

In another aspect of the present invention, there is provided a set of angle gauges for measuring angles in a workpiece being formed in a sheet metal bender. As previously described, each of the angle gauges in the set has an elongated shape, an indicia indicating a nominal angle, a base surface and an angled surface making a true angle with a projection of the base surface. This true angle corresponds to the sum of the nominal angle plus a supplement angle. The nominal angles on the angle gauges in the set are different from each other, and the supplement angle is common to all the angle gauges in the set. The entire set can thereby be used on a same sheet metal bender to measure different angles.

In yet another aspect of the present invention the set of angle gauges is part of a tool kit which also comprises printed math tips and charts related to the use of the angle gauges. The math tips and charts are expressed in fractions of an inch. This tool kit is advantageous for use on a job site by tradesmen having no calculator nor trigonometric table and wherein their measuring instruments are limited to a square and a measuring tape.

In a further aspect of the present invention, there is provided a method for bending a workpiece to a nominal angle in a sheet metal bender. This method comprises the first step of providing an angle gauge as previously described. Subsequent steps consist of setting and clamping the workpiece in the sheet metal bender and forming an obtuse angle in the workpiece. The angle gauge is laid in the obtuse angle and over the nose bar, and the bending of the workpiece is carried out until the workpiece is in contact with the angled surface of the angle gauge.

The apron bar can be released lightly to verify the spring back in the material. When over-bending to compensate for spring back in the workpiece, the angle gauge floats upward to accommodate for the additional displacement of the apron bar, and moves back to the bottom of the bend as soon as the apron bar is tilted back down.

Once the workpiece is in full contact with the angled surface of the angle gauge without any pressure thereon from the apron bar, the bent obtained in the workpiece corresponds to the nominal angle shown on the indicia of the specific angle gauge used.

The angle gauge is free to slide from one end of the workpiece to the other to quickly verify a desired angle. The measured angle can be gauged at a glance from the position normally held by a person operating the bender.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

One embodiment of the present invention is illustrated in the accompanying drawings, in which like numerals denote like parts throughout the several views, and in which.

DESCRIPTION OF THE PREFERRED EMBODIMENT

Figure 1:
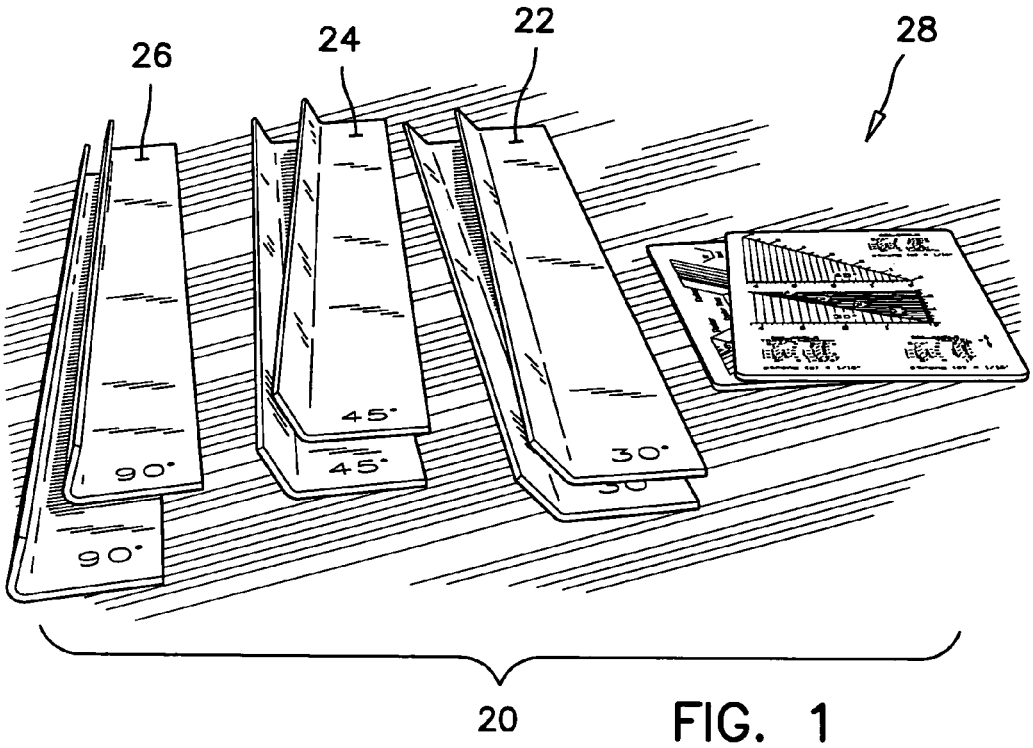
FIG. 1 is a perspective end view of three pairs of floating angle gauges according to the preferred embodiment of the present invention, and printed cards showing corresponding math tips and charts.

While this invention is susceptible of embodiment in many different forms, there is shown in the drawings and will be described in details herein a specific embodiment, with the understanding that the present disclosure is to be considered as an example of the principles of the invention and is not intended to limit the invention to the embodiment illustrated and described.

Referring to FIG. 1, the tool kit 20 according to the preferred embodiment of the present invention contains several floating angle gauges 22, 24, and 26, for measuring common angles, and math tips and charts 28 that are printed on card stock for example or in a booklet form. For convenience, these charts are illustrated and described as stiff cards having a size suitable for carrying in a shirt pocket.

Figure 2:
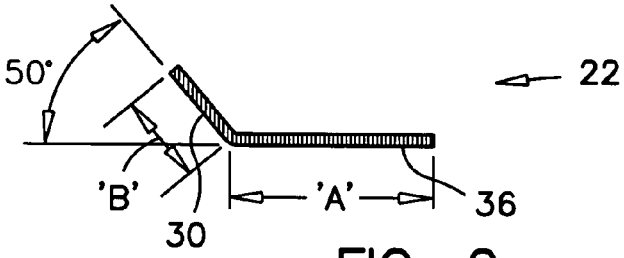
FIGS. 2, 3 and 4 illustrate respectively the end view of a 30°, 45° and 90° floating angle gauges according to the preferred embodiment of the present invention.
Figure 3:
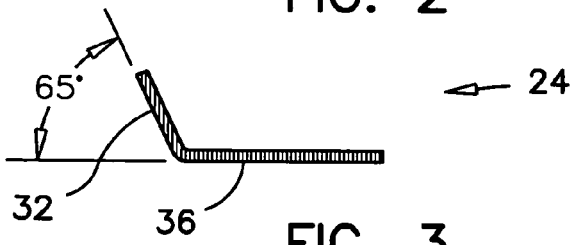
Figure 4:
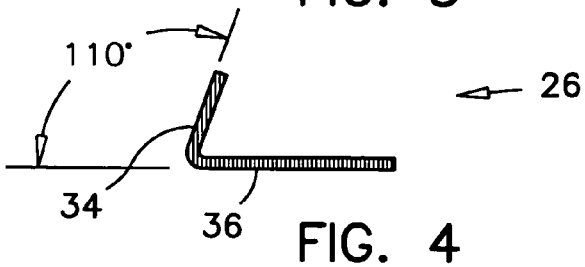

The preferred floating angle gauges 22, 24, 26 are made of bent or extruded metal strips or bars and have a length of about 10–14 inches. Each of these metal strips or bars has an angled surface 30, 32 or 34 of which the true angle from a projection of the base surface 36 corresponds to the nominal angle to be formed therewith plus a supplement angle. The angled surface 30 of the 30° angle gauge 22 forms a true angle of 50° from a transverse projection of the base surface 36 thereof, as illustrated in FIG. 2. The 45° angle gauge 24 has an angled surface 32 angled at 65°, and the 90° angle gauge 26 has an angled surface 34 angled at 110°. In the illustrated examples of FIGS. 2–4, the supplement angle in all three angle gauges is 20°. The nominal angle of each angle gauge is shown on an indicia engraved on or otherwise affixed to each angle gauge, as illustrated in FIG. 1. The amplitude of the supplement angle will be explained below.

Figure 5:
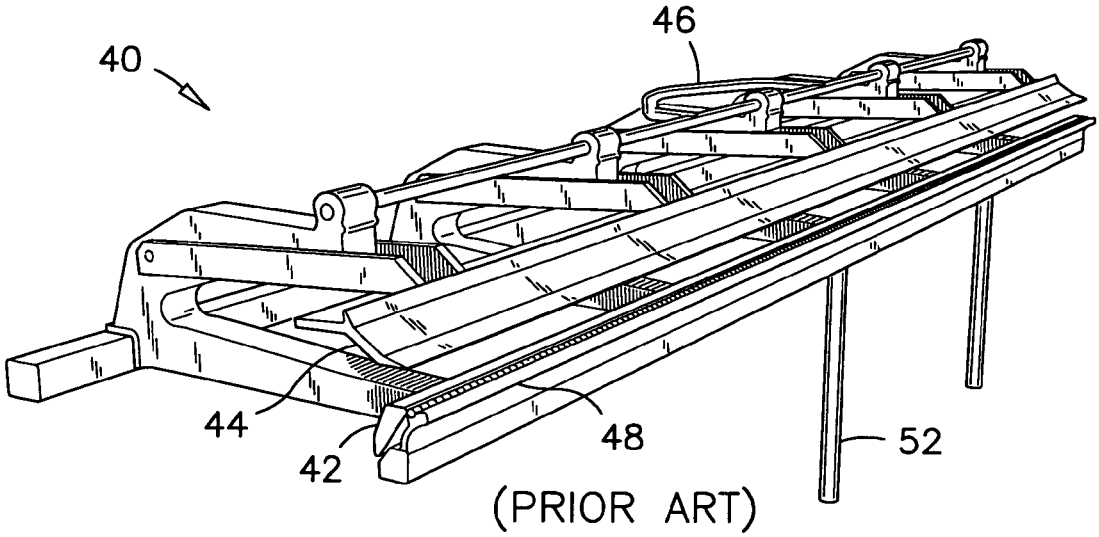
(PRIOR ART) FIG. 5
FIGS. 5 and 6 illustrate respectively a perspective view and an end view of a common portable sheet metal bender used by aluminum siding installers.
Figure 6:
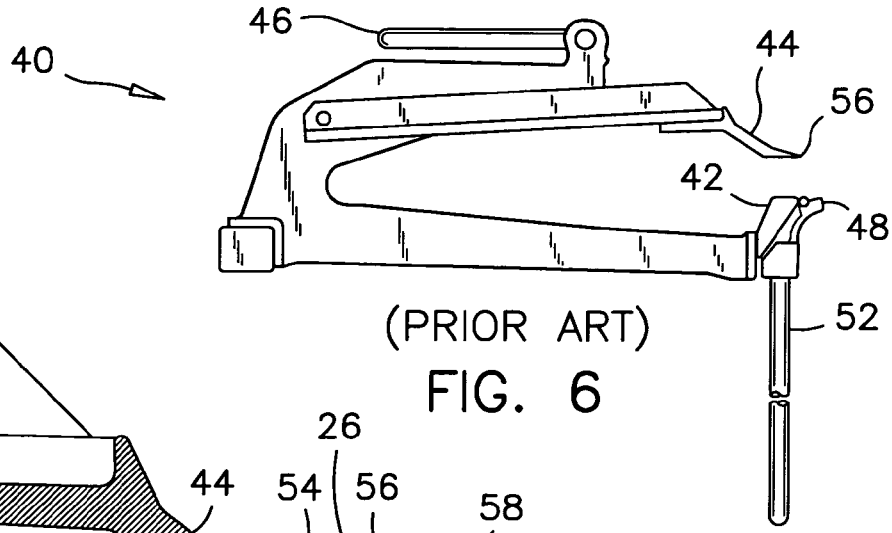
(PRIOR ART) FIG. 6
Figure 7:
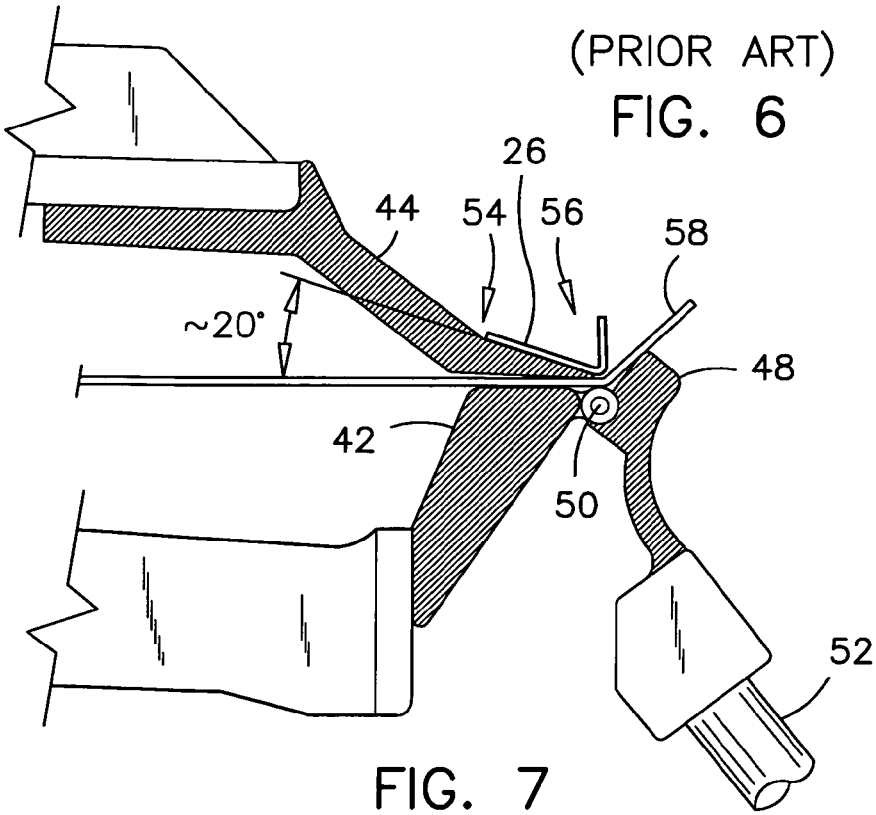
FIG. 7 shows an enlarged end view of the apron bar, anvil bar and pinch bar of the sheet metal bender illustrated in FIGS. 5 and 6.

Referring now to FIGS. 5–7, the common sheet metal bender 40 has an anvil bar 42, a nose bar 44 articulated up and down by cams and a lever 46, and an apron bar 48 articulated angularly about a pivot axis 50 by a pair of handles 52. In a common portable bender, the top surface of the nose bar 44 tapers down and forms and angle of about 20°, as illustrated in FIG. 7, with the clamping surface of the anvil bar 42. This angle becomes the supplement angle in the angle gauges 22, 24, 26.

The sheet metal bender illustrated in FIGS. 5–7 is referred to in the industry as a Port-O-Bender™, available from Tapco™ International Corporation, having distributors around the world. The nose bar 44 on these benders has a slope divergence 54 on its upper surface at a distance of about 1⅛ inches from its outer edge 56. Therefore the preferred width 'A' of the base surface 36 of each angle gauge 22, 24 or 26 is 1⅛ inches or slightly less.

Along the same lines, the preferred width 'B' of the angled surface 30, 32 and 34 is about ½ inch, such that each angle gauge is usable to measure tight bends on a workpiece.

In use, one of the angle gauges 22, 24 or 26 is laid against the nose bar 44 and the workpiece 58 being bent. The angle measured is the inside angle of the workpiece 58 as the apron bar 48 is being tilted upward. Therefore, the angle gauge having a 50° angled surface is used to measure an inside angle of 30°. Similarly the other angle gauges are used to measure inside angles corresponding to the angled surface on the respective bar less the angle of the nose bar of the particular bender.

To form a bend, the workpiece 58 is set and clamped in the bender 40 and a slight obtuse angle is formed therein as illustrated in FIG. 7. Then one or a pair of angle gauges 22, 24 or 26 is laid against the top surface of the nose bar 44 and in this obtuse angle. The workpiece 58 is then bent by working the apron bar 48 until the bent portion of the workpiece 58 touches along the angled surface of the angle gauge 22, 24, or 26. The spring back in the material is verified by releasing the apron bar lightly. If over-bending is required, the angle gauge moves upward across the nose bar according to the movement of the apron bar, and slides back to a measuring position when the apron bar is released. The workpiece 58 is then removed from the bender with the proper bent formed therein.

The angle gauges 22, 24, 26 are not fixed to the bender or to the workpiece. The angle gauges are loosely laid onto the workpiece after setting a small obtuse angle in the workpiece. The angle gauge can be slid from one end of the bender to the other or used in pair, one on each end of the bender, to quickly measure an angle along the entire length of a workpiece 58. These angle gauges are also convenient for verifying the accuracy of a new bender to quickly identify a twisted apron bar 48 for example.

Figure 8:
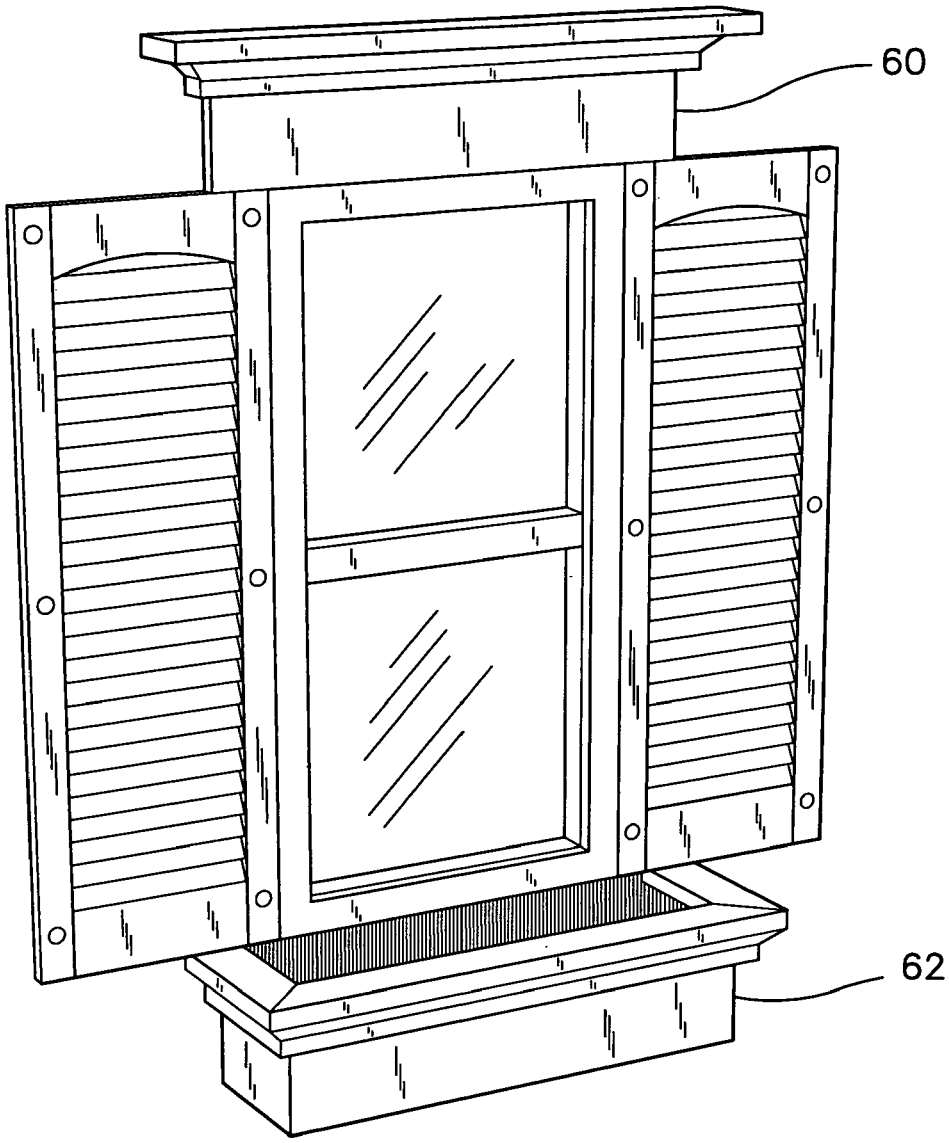
(PRIOR ART) FIG. 8
FIG. 8 illustrates an example of a window and of a flower box capped with sheet aluminum and decorated with matching frieze and moulding made with the tool kit according to the present invention.
Figure 9:
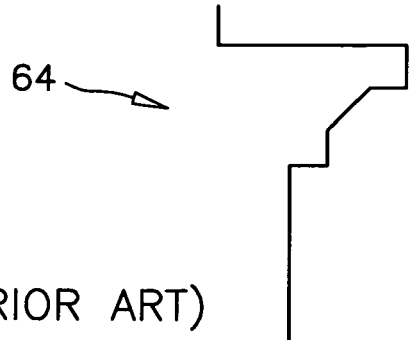
(PRIOR ART) FIG. 9
FIGS. 9 and 10 illustrate cross-sections of friezes and cornices made using the tool kit according to the present invention.
Figure 10:
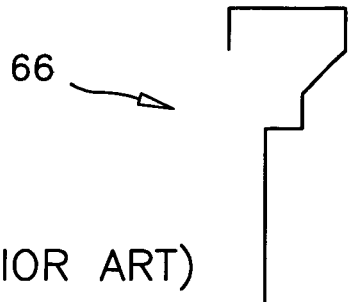
(PRIOR ART) FIG. 10

Referring now to FIGS. 8–10 there are illustrated therein a window header 60 manufactured using the tool kit according to the present invention and a covered flower box 62 having the same style as the window header 60. There are also illustrated the cross-sections of two different types of headers or cornices 64, 66 showing typical locations of 45° angles found on these mouldings.

Figure 11:
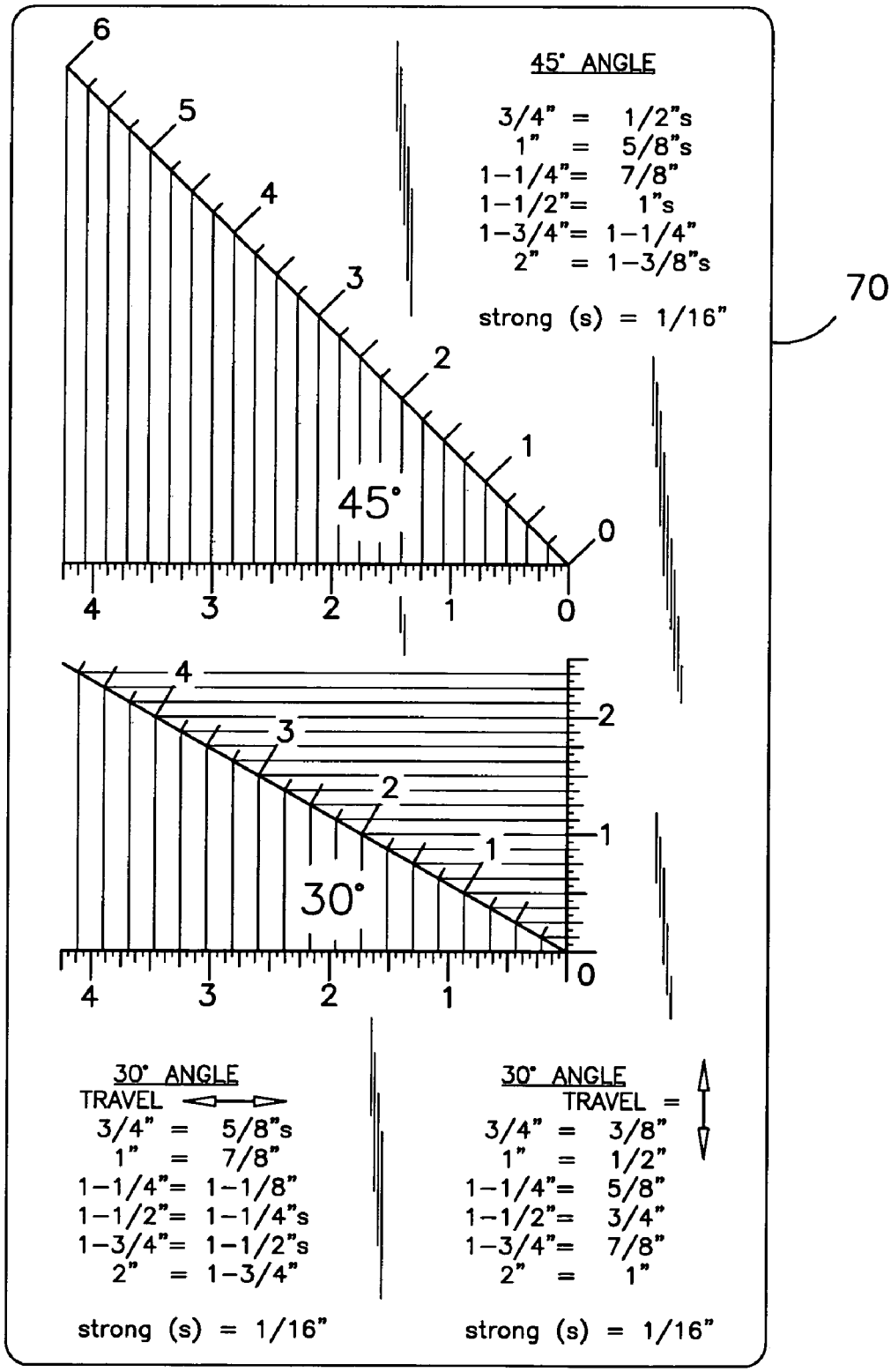
(PRIOR ART) FIG. 11
FIGS. 11 and 12 illustrate two examples of printed cards showing math tips and charts included in the tool kit according to the present invention.
Figure 12:
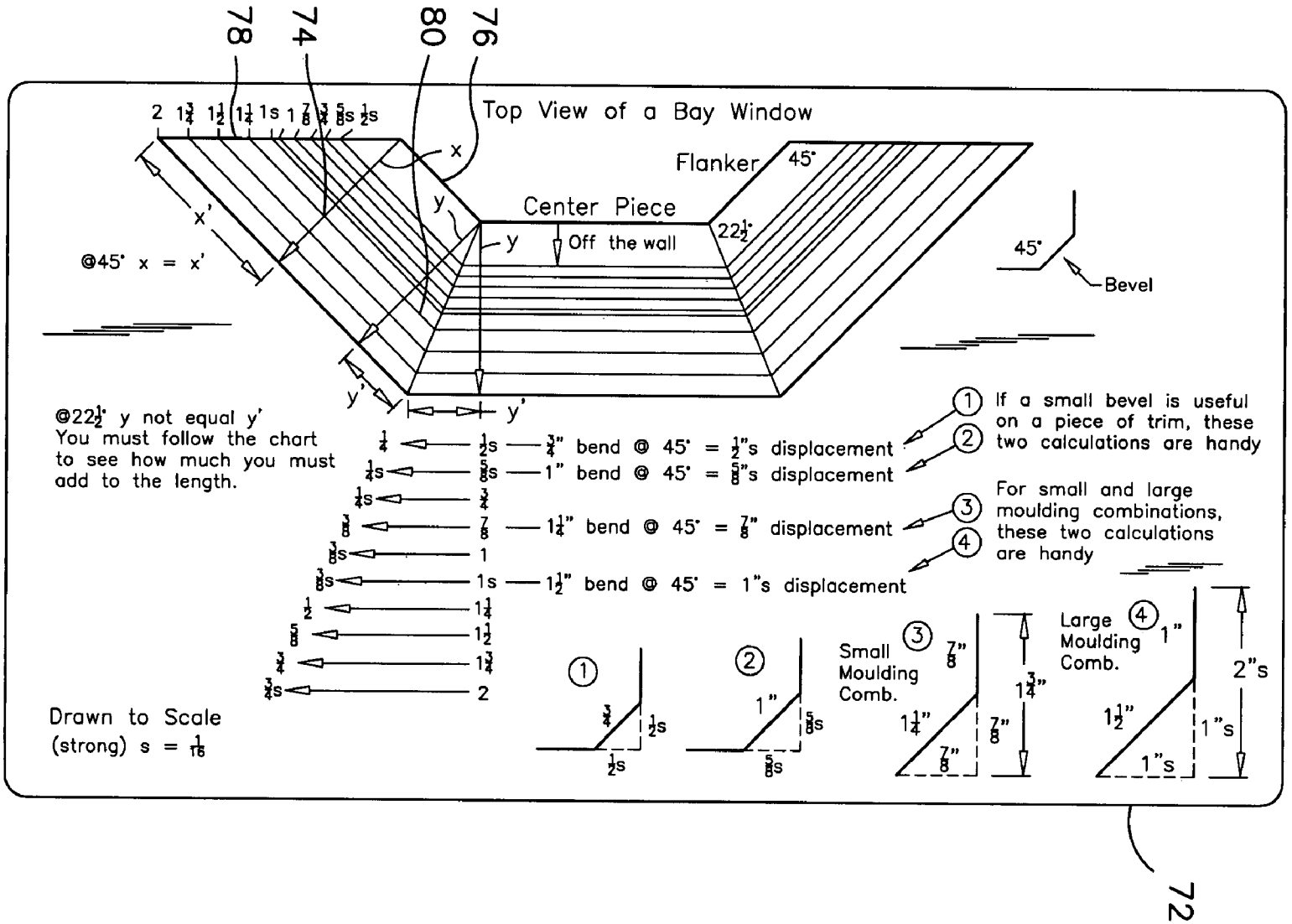
(PRIOR ART) FIG. 12

FIGS. 11 and 12 illustrates math tips and charts printed on stiff cards. The preferred card stock is a stiff plastic material or a cardboard laminated with a plastic cover. These cards 70, 72 have dimensions to fit into a common shirt pocket, such that they can be carried along and stowed away by tradesmen during normal working activities. These printed math tips and charts may include for example, trigonometric tables associated with the bending of sheet metal in caps for bay window frames, planar window frames, mouldings, friezes and cornices.

For example, the card 70 illustrated in FIG. 11 shows the sine and cosine dimensions of a 45° angle and of a 30° angle. These charts are used to calculate the projection at right angle from a wall of a section extending at 30° or 45° from that wall. These charts are also used to calculate the total height and depth of a moulding having one or more segments extending at 30° or 45° from a mounting surface, such as those illustrated in FIGS. 9 and 10.

Also for example, the card 72 shown in FIG. 12 has instructions to calculate the projections at right angle from a base line on a workpiece used for capping the frame of a bay window. For example, a ⅞" right angle projection 74 from a base line 76 of a piece extending at 45° from a wall surface 78 corresponds to a distance of 1¼" along the wall (⅞"×secant 45°) and to a ⅜" linear projection 80 (⅞"×tangent 22½°) at the 22½° corner.

Although only two math tip and chart cards 70, 72 have been illustrated, it will be appreciated that a number of additional printed instruction sheets 28 may be included in the tool kit according to the preferred embodiment. For example, there may be included an entire booklet showing tips and related trigonometry for making mantles, faceted columns, window sills, window headers, caps for channelled vinyl windows, cornices and friezes for restoring heritage buildings, etc.

It will be readily appreciated that the floating angle gauges 22, 24 and 26 for another type of bender may have a different width or a different supplement angle to accommodate the shape of the nose bar of that other bender. It will also be appreciated that the tool kit may contain other gauges having other nominal angles than those illustrated.

Although the tool kit according to the present invention is described and illustrated as a combination of floating angle gauges and printed math tips and charts, it will be appreciated that the floating angle gauges can be used alone without the math charts to obtain a new and useful result. Therefore, it should be appreciated that the essence of the present invention consists of the angle gauges with or without the printed math tips and charts.

As to other manner of usage and operation of the present invention, the same should be apparent from the above description and accompanying drawings, and accordingly further discussion relative to the manner of usage and operation of the invention would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. For example the angle gauges 22, 24 and 26 may also be made of extruded plastic material, or wood. Therefore, the above description and the illustrations should not be construed as limiting the scope of the invention which is defined by the appended claims.

I claim:

1. In combination, a sheet metal bender having a nose bar and an anvil bar, and an angle gauge laid on said nose bar and included within a length of said nose bar; for measuring an inside angle in a workpiece being formed in said sheet metal bender, said nose bar having a top surface defining a supplement angle with said anvil bar; said angle gauge comprising;

an elongated shape having juxtaposed longitudinal base surface and longitudinal angled surface; said base surface being laid flat against said top surface of said nose bar, and an indicia thereon indicating a nominal angle;

said angled surface making a true angle with a transverse projection of said base surface and said true angle corresponding to said nominal angle plus said supplement angle.

2. The combination as claimed in claim 1, wherein a material of construction of said angle gauge is sheet metal.

3. The combination as claimed in claim 1, wherein said supplement angle is 20°.

4. The combination as claimed in claim 1, wherein said angle gauge has an uniform thickness and an uniform cross-section.

5. The combination as claimed in claim 1 wherein said angle gauge further has a longitudinal bent therein joining said longitudinal base surface and said longitudinal angled surface, and said true angle is also defined by an extent of said bent.

6. A set of angle gauges for measuring angles in a workpiece being formed in a sheet metal bender, each of said angle gauges comprising:

an elongated shape having juxtaposed longitudinal base surface and longitudinal angled surface;

an indicia thereon indicating a nominal angle;

said angled surface making a true angle with a transverse projection of said base surface and said true angle corresponding to the sum of said nominal angle plus a supplement angle;

wherein said nominal angles on said angle gauges in said set are different from each other, and said supplement angle is common to all said angle gauges in said set.

7. The set of angle gauges as described in claim 6, wherein said nominal angles are 30°, 45° and 90°.

8. The set of angle gauges as described in claim 7, wherein said supplement angle is 20°.

9. A tool set for working sheet metal, comprising;

a set of angle gauges for measuring angles in a workpiece being formed in a sheet metal bender, each of said angle gauges comprising:

an elongated shape having juxtaposed longitudinal base surface and longitudinal angled surface;

an indicia thereon indicating a nominal angle;

said angled surface making a true angle with a transverse projection of said base surface and said true angle corresponding to the sum of said nominal angle plus a supplement angle;

wherein said nominal angles on said angle gauges in said set are different from each other, and said supplement angle is common to all said angle gauges in said set, and printed math tips and charts related to at least one of said nominal angles.

10. The tool set as claimed in claim 9, wherein said supplement angle is 20°.

11. The tool set as claimed in claim 9, wherein said printed math tips and charts comprise trigonometric tables.

12. The tool set as claimed in claim 9, wherein said printed math tips and charts are printed on a stiff card.

13. The tool set as claimed in claim 12, wherein said stiff card has dimensions to fit in a common shirt pocket.

14. The tool set as claimed in claim 9, wherein said printed math tips and charts are contained in a booklet.

15. The tool set as claimed in claim 9, wherein said printed math tips and charts are expressed in fractions of an inch.

16. The tool set as claimed in claim 9, wherein said angle gauges have a length of about 10–14 inches.

17. The tool set as claimed in claim 9, wherein said angle gauges have means for sliding along and across a nose bar of said sheet metal bender.

18. The tool set as claimed in claim 9, wherein said math tips and charts contain fabrication instructions for making sheet metal components.

19. The tool set as claimed in claim 9, wherein said nominal angles are 30°, 45° and 90°.

20. A method for bending a workpiece to a desired angle on a sheet metal bender, comprising the steps of;

providing an angle gauge having an elongated shape and juxtaposed longitudinal base surface and longitudinal angled surface, with said angled surface making a true angle with a transverse projection of said base surface, said true angle corresponding to the sum of said desired angle plus a supplement angle corresponding to a transverse slope of a nose bar of said bender;

setting and clamping said workpiece in said sheet metal bender;

forming an obtuse angle in said workpiece, placing said angle gauge in said obtuse angle and over said nose bar, and bending said workpiece until said workpiece is in contact with said angled surface of said angle gauge.

* * * * *